US006994559B1

(12) United States Patent
Sanftleben

(10) Patent No.: US 6,994,559 B1
(45) Date of Patent: Feb. 7, 2006

(54) DEVICE FOR THE ELECTRICAL CONNECTION OF CONTACT PINS TO CONNECTING PINS OF A PLUG-IN CONNECTOR FORMED FROM THE DEVICE

(75) Inventor: Emanuel Sanftleben, Geisling (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/014,924

(22) Filed: Dec. 17, 2004

Related U.S. Application Data

(60) Provisional application No. 60/603,328, filed on Aug. 20, 2004.

(30) Foreign Application Priority Data

Aug. 20, 2004 (DE) ..... 10 2004 040 489
Nov. 25, 2004 (EP) ..... 04106076

(51) Int. Cl.
*H01R 33/00* (2006.01)

(52) U.S. Cl. ..... 439/34; 439/130; 439/557

(58) Field of Classification Search ..... 439/34, 439/130, 730, 557, 558
See application file for complete search history.

(56) References Cited

U.S. PATENT DOCUMENTS 2,117,762 A * 5/1938 Douglas ..... 362/519
3,119,997 A * 1/1964 Ast et al. ..... 340/815.67
6,371,775 B1 * 4/2002 Nakatsuka ..... 439/127
6,666,190 B1 * 12/2003 DiMaria et al. ..... 123/470
6,716,071 B2 * 4/2004 Miyazaki ..... 439/859
6,729,903 B1 * 5/2004 Clark ..... 439/590
6,769,637 B2 * 8/2004 Nakamura et al. ..... 239/585.1
6,904,895 B1 * 6/2005 Moreno ..... 123/470

FOREIGN PATENT DOCUMENTS

| | | |
|---|---|---|
| DE | 197 15 487 | 10/1998 |
| DE | 198 44 743 | 6/2000 |
| WO | 98/47188 | 10/1998 |

* cited by examiner

*Primary Examiner*—Gary Paumen
*Assistant Examiner*—Phuongchi Nguyen
(74) *Attorney, Agent, or Firm*—Baker Botts L.L.P.

(57) ABSTRACT

A device (10) has a locating face (22) offset laterally with respect to the pilot section (16) and extending substantially tangentially, which, when the pilot section (16) is inserted into a housing hole, interacts with a corresponding locating face of the housing in such a way as to prevent rotation, wherein the locating face (22) of the connecting device (10) is formed with a plastically deformable shoulder (24) on each of the locating-face areas lying tangentially opposite each other and/or the circumferential region of the pilot section (16) is formed by a plurality of radially elastic spigots (20) mutually spaced in the circumferential direction. This enables a functionally optimized and zero-play interaction between the corresponding locating faces.

13 Claims, 2 Drawing Sheets

DEVICE FOR THE ELECTRICAL CONNECTION OF CONTACT PINS TO CONNECTING PINS OF A PLUG-IN CONNECTOR FORMED FROM THE DEVICE

PRIORITY

This application claims priority to U.S. Provisional Application 60/603,328 filed Aug. 20, 2004; German Application No. 10 2004 040 489.5 filed on Aug. 20, 2004 and European Application No. 04106076.5 filed Nov. 25, 2004.

TECHNICAL FIELD OF THE INVENTION

The present invention relates to a device for the electrical connection of contact pins to connecting pins of a plug-in connector formed from the device. In addition, the invention relates to an application for such a connecting device.

DESCRIPTION OF THE RELATED ART

A connecting device of this type in the form of a contact plate plugged onto two contact pins of a piezoelectric actuator is known from DE 197 15 487 A1. The known contact plate is made of insulating plastic and provided with through-holes for the passage of the contact pins which extend out almost parallel to the longitudinal direction of the actuator. Inside the contact plate electrical conductors are taken from a contact-making point at each through-hole to connecting pins that project laterally out of the contact plate. By injection molding of an upper section of an actuator housing and the contact pins on which the contact plate has been mounted and made contact, a connector package is formed in which the laterally extending connecting pins project into a connecting chamber so that at this point a plug-in connector is formed by means of which the piezoelectric actuator can be connected to an external conductor arrangement.

A connecting device in the form of a contact blade carrier is also known from DE 198 44 743 C1. The known contact blade carrier is used to seal and position contact pins of a piezo actuator for the injection valve of an internal combustion engine and has a plastic mounting body having through-holes for the passage of the contact pins. After the contact blade carrier is mounted on the contact pins of the piezo actuator the ends of the contact pins projecting out of the through-holes come into contact with welding lugs molded in the plastic body and can be welded to said lugs. The welding lugs are electrically connected to laterally extending contact blades that act as connecting pins of a plug-in connector formed by a plastic injection molding.

The manufacture of an electrical connection by means of the known connecting devices is problematic in that after their assembly these devices are often not located in a precisely defined position and hence often need additional alignment by hand. If such adjustment of the position and orientation of the connecting device is not performed, it is harder to make the electrical contact with the contact pins. Furthermore, in a subsequent injection molding of the connecting device, where the positional accuracy is inadequate there is the risk that injection-molding material will escape unintentionally through gaps that would be substantially smaller and hence able to provide a seal if the connecting device were in a precisely defined position.

SUMMARY OF THE INVENTION

Hence it is an object of the present invention to provide a connecting device of the type cited in the introduction, in which a relatively precisely defined position of the connecting device with respect to a housing is guaranteed in a straightforward way.

According to the invention, a connecting device is provided for electrical connection of contact pins which project out of an axial hole in a collar-like housing to connecting pins of a plug-in connector formed from the device, comprising a mounting body having a pilot section that is suitably designed to engage axially in the hole and is provided with through-holes for the passage of the contact pins and having a locating face offset laterally with respect to the pilot section and extending substantially tangentially which, when the pilot section is inserted into the hole, interacts with a corresponding locating face of the housing in such a way as to prevent rotation, the locating face of the connecting device being formed with a plastically deformable locating-face shoulder on each of the locating-face areas lying tangentially opposite each other with respect to the pilot section, and/or the circumferential region of the pilot section being formed by a plurality of radially elastic spigots mutually spaced in the circumferential direction.

The first essential feature is that the mounting body has a pilot section for axial engagement in an axial hole of a housing. Even this advantageously effects a certain "coarse alignment" of the position of the connecting device during its assembly and allows comparatively narrow gaps to be provided between the connecting device and the housing in a straightforward way.

A locating face of the mounting body, extending substantially tangentially, which interacts with a corresponding locating face of the housing, provides a means of preventing rotation and also, if need be, improved positioning of the connecting device with respect to the housing.

For the more precise definition of the position of the connecting device with respect to the housing, the last essential feature according to the invention is that the locating face of the connecting device is formed with a plastically deformable locating-face shoulder on each of the locating-face areas lying tangentially opposite each other with respect to the pilot section, and/or the circumferential region of the pilot section is formed by a plurality of radially elastic spigots mutually spaced in the circumferential direction. This enables a "zero-play" interaction between pilot section and housing hole and between the corresponding locating faces, respectively, and hence a particularly precise definition of the position of the connecting device.

In a preferred embodiment the mounting body comprises a plastic molding that forms both the pilot section and the locating face as a single connected piece. Apart from being easy to manufacture, this measure has the advantage, for instance, that the locating face used to define the position has a particularly precise position with respect to the pilot section.

If the aforementioned plastically deformable locating-face shoulders are provided on the locating face of the connecting device, then the locating face is preferably formed in such a way that its interaction with the corresponding locating face of the housing occurs substantially only against the locating-face areas lying tangentially opposite each other. This makes optimum use of the advantageous action of the deformable shoulders.

If the circumferential region of the pilot section is formed by the aforementioned plurality of spigots, then these spigots can, for example, be identical in design and be spaced equidistantly viewed around the circumference. This achieves, for example, a particularly good centering of the pilot section in the housing hole. In order to guarantee that the pilot section can be inserted easily, it is advantageous if the spigots are each provided with an insertion bevel.

In order to bring the corresponding locating faces into interaction easily and reliably when inserting the pilot section into the hole, it is advantageous if at least one of the locating faces and/or one or more of the plastically deformable locating-face shoulders that may be provided are provided with an insertion bevel.

In one embodiment it is provided that the mounting body comprises a plastic molding (for example the aforementioned part forming both the pilot section and the locating face) in which are molded the connecting pins, contact parts for making contact with the contact pins, and an electrical conductor arrangement between the connecting pins and the contact parts. In particular, it is possible to manufacture substantially the whole connecting device from a single plastic body having the said molded components.

In a preferred embodiment, contact parts for making contact with the contact pins are implemented as welding lugs to be welded to the contact pins. Such welding lugs are preferably arranged adjacent to the through-holes in such a way that they fit against the contact pins and hence can be welded particularly easily.

A preferred application of the connecting device is for making electrical contact with contact pins of a piezoelectric actuator of an internal combustion engine fuel injector. The fuel injector may be a diesel injector of a reservoir injection system for example.

BRIEF DESCRIPTION OF THE DRAWINGS

The invention is described in more detail below based on an exemplary embodiment with reference to the attached drawings, in which.

DETAILED DESCRIPTION OF THE PREFERRED EMBODIMENTS

Figure 1:
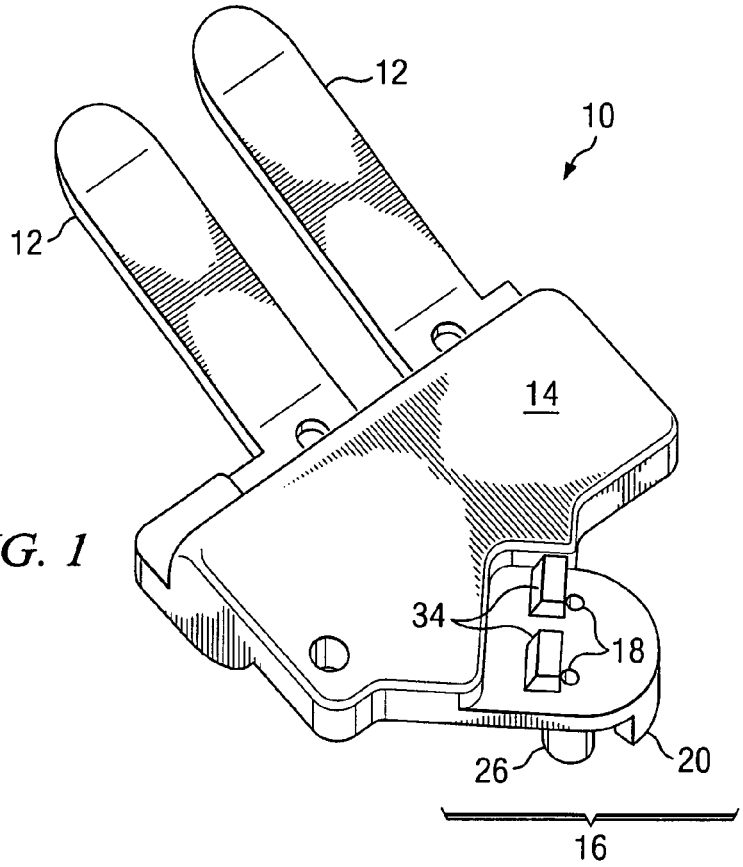
FIG. 1 shows a perspective view of a contact blade carrier according to the invention viewed obliquely from above.
Figure 2:
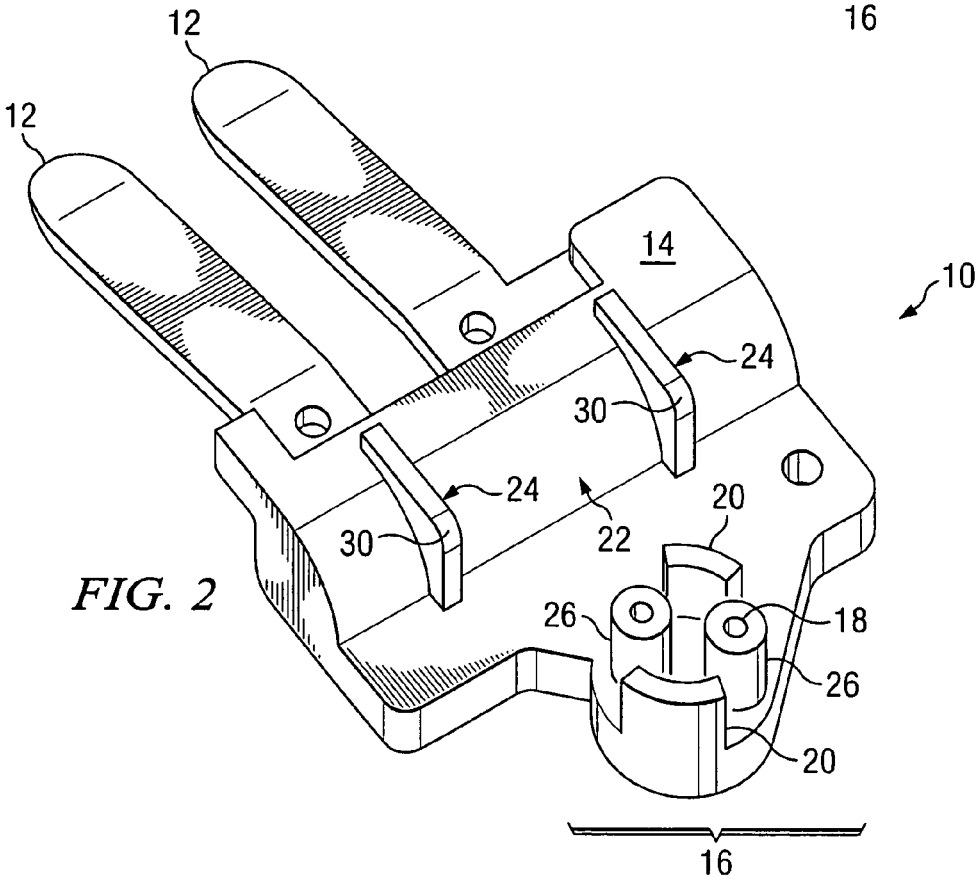
FIG. 2 shows a perspective view of the contact blade carrier viewed obliquely from below.

FIGS. 1 and 2 show a contact blade carrier (connecting device), labeled 10 as a whole, for the electrical connection of contact pins of a piezoelectric actuator (not shown) having contacts blades 12 (connecting pins) that are molded in a plastic body 14 and together with a plastic injection molding (not shown) form a plug-in connector of a fuel injector.

In the example illustrated, the body 14 is a plastic molding fabricated in one piece having a pilot section 16 whose overall outline is cylindrical, which is suitably designed to engage axially in an axial hole of a collar-like housing of the fuel injector, and is provided with through-holes 18 for the passage of the contact pins of the piezo actuator, and having a locating face 22 offset laterally with respect to the pilot section 16 and extending substantially tangentially at a separation from the pilot section 16. After an assembly of the contact blade carrier 10, in the process of which the pilot section 16 is inserted axially into the hole of the injector housing, the locating face 22 interacts with a corresponding locating face of this injector housing in such a way, to be described below, as to prevent rotation. The locating face 22 of the contact blade carrier 10 has two locating-face areas lying tangentially opposite each other with respect to the pilot section 16, in each of which one of two plastically deformable locating-face shoulders 24 extends upward out of the plane of the locating face 22.

In the example shown, these plastically deformable shoulders 24 are molded on the plastic body 14 as a single piece. When the pilot section 16 is inserted into the housing hole, the shoulders 24 can be plastically deformed by the corresponding locating face provided on the housing, so that at the end of the insertion process the two corresponding locating faces fit against each other with zero play in the area of the shoulders 24.

For the general case, there are various options available for the design of the plastically deformable locating-face shoulders 24. Thus the shoulder 24 could also be formed as a part added separately onto the locating face 22 (instead of being molded on as a single piece). This version would be particularly advantageous if the material used for the plastic body 14 is unsuitable for plastic deformation.

The shoulders 24 preferably have a fin-shaped design as shown in FIG. 2, each with a fin tail that extends away from the locating face 22 and connects via an insertion rounding or insertion bevel 30 to the fin section which is effective in the interaction of the locating faces.

It is also conceivable to form a shoulder 24 made of a material selected specially for its plastic deformability, in a two-component injection molding process at the same time as the remaining plastic body 14 is formed.

The circumferential region of the pilot section 16 is formed by two diametrically opposed, radially elastic spigots 20. The pilot section 16 and hence the whole contact blade carrier 10 is arranged simply and reliably in a well defined position with respect to the housing by means of these spigots 20.

In order to make it easier to insert the pilot section 16 into the housing hole, the exposed ends of the spigots 20 can also be provided with insertion bevels.

In addition to the spigots 20, the pilot section 16 also has two collars 26 which in the example shown are formed like the spigots 20 as a single piece with the remaining plastic body 14 and act as the guide and insulation for the contact-making contact pins in the area of the pilot section 16.

In the manufacture of the contact blade carrier 10, the contact blades 12 which lead to the welding lugs 34 via an electrical conductor arrangement formed in one piece (inside the plastic body 14) are molded in the plastic material used to form the plastic body 14.

In the assembly of the contact blade carrier 10, the contact pins of the piezo actuator pass through the through-holes 18 and fit with their ends against the welding lugs 34 arranged adjacent to these through-holes 18, so that the contact pins can be welded easily to the welding lugs 34 in order to establish an electrical contact.

Figure 3:
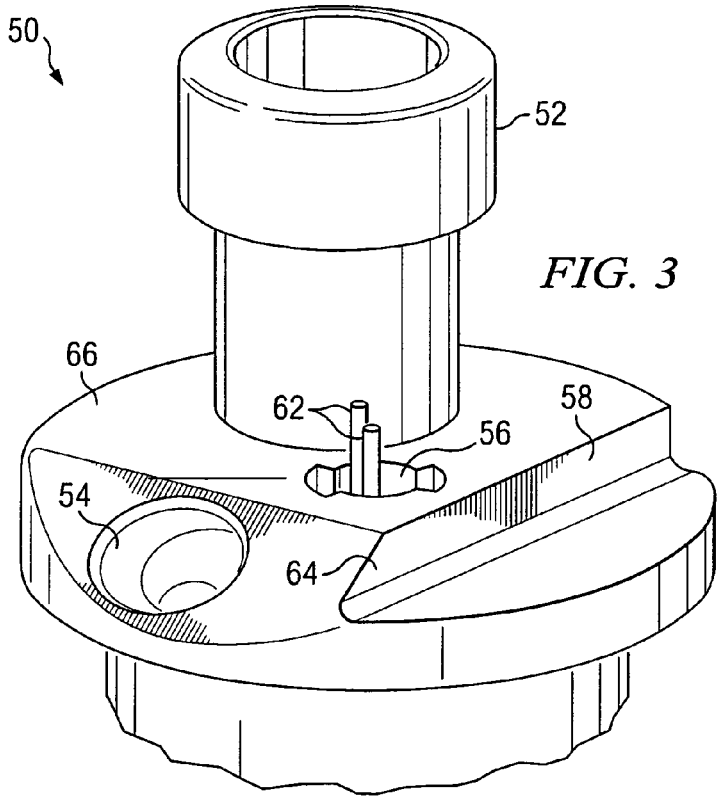
FIG. 3 shows a perspective view of an upper end region of a housing of a fuel injector to be fitted with the contact blade carrier.

FIG. 3 shows the injector housing, labeled 50 as a whole, in its upper area (away from the injection nozzle) prior to the contact blade carrier 10 described above being fitted.

The injector housing 50 has a high-pressure plastic supply connection 52 and a plastic leakage connection 54 in order to supply fuel to a hydraulic plastic servo valve located in the lower area of the housing (not shown) in a manner known in the art and hence not requiring explanation here.

The servo valve is controlled by means of the piezo actuator, which is also located in the lower area of the housing 50 and connected via an operative connection to an actuator of the servo valve.

In FIG. 3 one can also see the axial hole 56 of the overall collar-like housing 50, out of which the contact pins 62 of the piezo actuator project upward after insertion (from below) of a piezoelectric unit containing the piezo actuator.

After the piezoelectric unit is fitted in the injector housing 50, the contact blade carrier 10 described above with reference to FIGS. 1 and 2 is mounted from above on a locating face 66 of the housing 50, said locating face having a step 64, so that the contact pins 62 of the piezo actuator pass through the through-holes 18 of the pilot section 16, and then can be welded to the welding lugs 34. In order for this process to achieve a position of the mounted contact blade carrier 10 with respect to the housing 50 that is as well defined as possible, the housing 50 has a locating face 58 extending tangentially that interacts with the locating face 22 already described above of the contact blade carrier 10. In order to fit the corresponding locating faces 22, 58 together in an easy and reliable way, the housing 50 can be provided with an inclined surface adjacent to the locating face 58.

Figure 4:
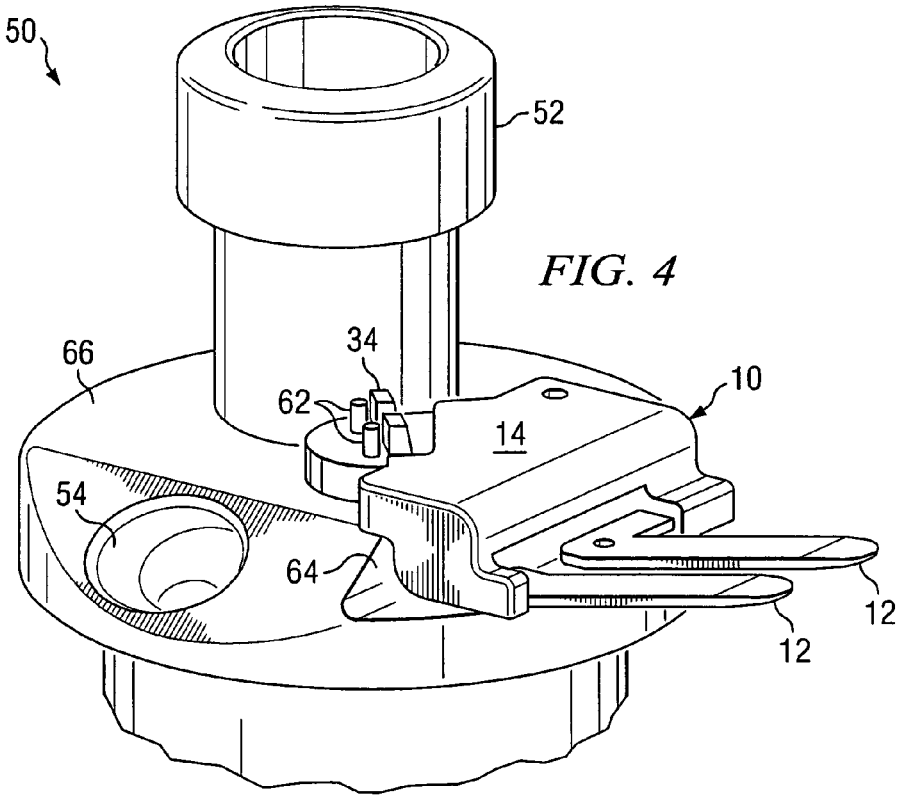
FIG. 4 shows a perspective view of the injector housing with fitted contact blade carrier.

FIG. 4 shows the situation immediately after the contact blade carrier 10 is mounted on the injector housing 50. The contact pins of the piezo actuator fit against the welding lugs 34 in this situation and are welded to these. A plastic casing (not shown) is then formed by plastic injection molding at the end shown of the injector housing 50, said casing also providing a connector package for the plug-in connector formed by means of the contact blades 12.

The stop surface between the contact blade carrier 10 and the step 64 in the injector housing 50 visible in this figure guarantees a means of preventing rotation whose stability and precision is considerably increased by the provision of the plastically deformable shoulders 24 and the radially elastically deflectable spigots 20.

In particular, to achieve as good a fit as possible between the welding lugs 34 and the contact pins 62 of the piezo actuator and to achieve as coaxial as possible an arrangement of the pilot section 16 in the housing hole 56, the design of the locating face 22 with the shoulders 24 on the one hand and the pilot section 16 with the elastic spigots 20 on the other is of particular importance. Even if the welding lugs have a certain manufacturing tolerance, they can be made to fit with the contact pins reliably and rigidly.

The interaction of the locating faces 22 and 58 takes place substantially only at mutually opposite locating-face areas, where the fixing realized by means of the plastically deformable shoulders 24 positions the contact blade carrier 10 and hence its pilot section 16 reliably and precisely even prior to welding (and also prior to plastic injection molding).

The basic idea of the described embodiment involves designing a contact blade carrier used for making electrical contact between the injector and the rest of the injection system with the aim of achieving a well-defined position and of fixing the carrier in this position. In particular, the means of preventing rotation is realized in this design by a deliberate deformation of the locating-face shoulders, made as compressible fins, during the assembly of the contact blade carrier. The centering of a pilot section of the contact blade carrier and the guarantee of a good fit of the contact pins against the contact parts (welding lugs) is achieved using elastically designed centering elements arranged, for example, along the surface of a cylinder. This results in the following advantages for example:

Minimization of the radial play of the contact blade carrier on the injector housing.

Avoidance of complex, additional positioning of the contact blade carrier by hand prior to the injection molding of the connector-side housing end.

Optimization of the tolerance equalization of the locating faces with a rotation of the contact blade carrier on the injector housing.

If the plastically deformable section(s) is (are) integrated directly in a plastic body of the contact blade carrier, then no additional components are required.

If a (e.g. final) plastic injection molding of the connector-side end is provided, any relaxation of the deformed section(s) over the lifetime of the injector is irrelevant, because the position of the plastic-enclosed components, so in particular also the contact blade carrier including deformed sections, are "frozen" in their position when the plastic material is applied.

Minimization of the number of bends required for the electrically conductive components of the connecting device and minimization of the position tolerances of the contact parts (e.g. welding lugs).

I claim:

1. A connecting device for electrical connection of contact pins which project out of an axial hole in a collar-like housing to connecting pins of a plug-in connector formed from the device, comprising a mounting body having a pilot section that is suitably designed to engage axially in the hole and is provided with through-holes for the passage of the contact pins, and having a locating face offset laterally with respect to the pilot section and extending substantially tangentially, which, when the pilot section is inserted into the hole, interacts with a corresponding locating face of the housing in such a way as to prevent rotation, wherein the locating face of the connecting device is formed with a plastically deformable locating-face shoulder on each of the locating-face areas lying tangentially opposite each other with respect to the pilot section and/or wherein the circumferential region of the pilot section is formed by a plurality of radially elastic spigots mutually spaced in the circumferential direction.

2. The connecting device as claimed in claim 1, wherein the mounting body comprises a plastic molding that forms both the pilot section and the locating face as a single connected piece.

3. The connecting device as claimed in claim 1, wherein the mounting body comprises a plastic molding in which are molded the connecting pins, contact parts for making contact with the contact pins, and an electrical conductor arrangement between the connecting pins and the contact parts.

4. The connecting device as claimed in claim 1, wherein welding lugs are arranged adjacent to the through-holes in such a way that they can be welded to the contact pins.

5. A method comprising the step of using a connecting device as claimed in claim 1 for making electrical contact with contact pins of a piezoelectric actuator of an internal combustion engine fuel injector.

6. The connecting device as claimed in claim 1, wherein the locating face of the connecting device is formed with a plastically deformable locating-face shoulder on each of the locating-face areas lying tangentially opposite each other with respect to the pilot section.

7. The connecting device as claimed in claim 6, wherein the locating face is designed in such a way that its interaction takes place substantially only at the mutually opposite locating-face areas.

8. A fuel injector for an internal combustion engine, comprising a piezoelectric actuator housed in an actuator housing, contact being made with the contact pins of said actuator by means of a connecting device as claimed in claim 1.

9. The fuel injector as claimed in claim 8, comprising a plastic injection molding that forms a casing at the connector-side end of the fuel injector.

10. The connecting device as claimed in claim 1, wherein the circumferential region of the pilot section is formed by a plurality of radially elastic spigots mutually spaced in the circumferential direction.

11. The connecting device as claimed in claim 10, wherein the spigots are each provided with an insertion bevel.

12. The connecting device as claimed in claim 10, wherein the spigots are identical in design and are spaced equidistantly viewed around the circumference.

13. The connecting device as claimed in claim 12, wherein the spigots are each provided with an insertion bevel.

* * * * *